US009897968B2

(12) United States Patent
Kim

(10) Patent No.: US 9,897,968 B2
(45) Date of Patent: Feb. 20, 2018

(54) IMAGE FORMING APPARATUS

(71) Applicant: S-PRINTING SOLUTION CO., LTD., Suwon-si, Gyeonggi-do (KR)

(72) Inventor: Tae Hong Kim, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 14/458,598

(22) Filed: Aug. 13, 2014

(65) Prior Publication Data

US 2015/0050060 A1 Feb. 19, 2015

(30) Foreign Application Priority Data

Aug. 14, 2013 (KR) ..... 10-2013-0096736

(51) Int. Cl.

| | |
|---|---|
| ***G03G 21/16*** | (2006.01) |
| ***G03G 15/00*** | (2006.01) |
| ***B65H 31/02*** | (2006.01) |
| ***B65H 31/10*** | (2006.01) |
| ***B65H 31/22*** | (2006.01) |
| ***B65H 85/00*** | (2006.01) |
| ***B65H 21/02*** | (2006.01) |

(52) U.S. Cl.

CPC ..... *G03G 21/16* (2013.01); *B65H 31/02* (2013.01); *B65H 31/10* (2013.01); *B65H 31/22* (2013.01); *B65H 85/00* (2013.01); *G03G 15/6538* (2013.01); *B65H 21/02* (2013.01); *B65H 2301/4212* (2013.01); *B65H 2301/4213* (2013.01); *B65H 2402/10* (2013.01); *B65H 2405/15* (2013.01); *B65H 2511/182* (2013.01); *B65H 2511/30* (2013.01); *B65H 2513/10* (2013.01); *B65H 2601/422* (2013.01); *B65H 2801/27* (2013.01); *G03G 15/6573* (2013.01); *G03G 2215/00911* (2013.01); *G03G 2221/1696* (2013.01)

(58) Field of Classification Search

CPC ..... G03G 2221/1696; G03G 15/6573; G03G 21/16; G03G 15/6538; G03G 2215/00911; B65H 21/02; B65H 31/10; B65H 31/22; B65H 85/00; B65H 2301/4212; B65H 2301/4213; B65H 2402/10; B65H 2405/15; B65H 2511/182; B65H 2511/30; B65H 2513/10; B65H 2601/422; B65H 2801/422; B65H 2801/27

See application file for complete search history.

(56) References Cited

U.S. PATENT DOCUMENTS

2010/0244371 A1* 9/2010 Suh ..... 271/225

* cited by examiner

*Primary Examiner* — Laura Martin
*Assistant Examiner* — John M Royston
(74) *Attorney, Agent, or Firm* — Staas & Halsey LLP

(57) ABSTRACT

An image forming apparatus is provided including an image forming unit configured to form an image on a print medium, and a printed medium post-processing unit configured to receive and post-process printed media on which an image forming process is completed from the image forming unit. The printed medium post-processing unit selectively comprises one of a first stacker module in which a first amount of post-processed printed media is able to be loaded, and a second stacker module in which a second amount of post-processed printed media is able to be loaded. Therefore, it may be possible to flexibly respond to a loading amount of the printed media necessary for the printed medium post-processing unit.

9 Claims, 5 Drawing Sheets

IMAGE FORMING APPARATUS

CROSS-REFERENCE TO RELATED APPLICATIONS

This application is related to, and claims the priority benefit of Korean Patent Application No. 10-2013-0096736, filed on Aug. 14, 2013 in the Korean Intellectual Property Office, the disclosure of which is incorporated herein by reference.

BACKGROUND

1. Field

Embodiments relate to an image forming apparatus including a printed medium post-processing unit configured to receive and post-process printed media on which an image forming process is completed.

2. Description of the Related Art

In general, image forming apparatuses are apparatuses for forming an image on a print medium, and correspond to a printer, a copy machine, a facsimile machine, a multi-function machine implemented by integrating at least two of these functions, or the like.

Some image forming apparatuses include a printed medium post-processing unit configured to receive, and then post-process, printed media on which an image forming process is completed.

The printed medium post-processing unit receives and aligns the printed media on which the image forming process is completed, and then performs a stapling process using a stapler and a bookbinding process in which the printed media are bound in a book form.

SUMMARY

According to an aspect of an exemplary embodiment an image forming apparatus is provided including a printed medium post-processing unit which may selectively change a loading amount of printed media.

According to an aspect of an exemplary embodiment, an image forming apparatus includes a printed medium post-processing unit that may perform post-processing on printed media to respond to an image forming apparatus having various printing speeds.

Additional aspects are forth in part in the description which follows and, in part, will be obvious from the description, or may be learned by practice of the invention.

In accordance with an aspect of an exemplary embodiment, an image forming apparatus includes an image forming unit configured to form an image on a print medium, and a printed medium post-processing unit configured to receive and post-process printed media on which an image forming process is completed from the image forming unit, wherein the printed medium post-processing unit selectively comprises one of a first stacker module in which a first amount of post-processed printed media is able to be loaded, and a second stacker module in which a second amount of post-processed printed media is able to be loaded.

The first stacker module may include a first tray in which the post-processed printed media are loaded, and a first support part configured to support the first tray.

The second stacker module may include a second tray in which the post-processed printed media are loaded, and a second support part configured to support the second tray to be movable up and down.

The printed medium post-processing unit may be disposed at an upper side of the image forming unit, and the second support part may extend up and down so that an upper portion of the second support part is disposed at one side of the post-processing module and a lower portion of the second support part is disposed at one side of the image forming unit.

The printed medium post-processing unit may selectively include one of a buffer module in which the plurality of printed media, on which the image forming process is completed in the image forming unit, temporarily stay, and a transfer module which transfers the printed media, on which the image forming process is completed in the image forming unit, to the post-processing module.

The buffer module may include a first buffer passage in which a first printed medium, on which the image forming process is completed, temporarily stays, a second buffer passage in which a second printed medium, on which the image forming process is completed, temporarily stays, and one transfer passage connected with the first and second buffer passages to transfer the printed medium transferred from the first and second buffer passages to the post-processing module.

The image forming unit may include a first paper discharging passage connected with the first buffer passage to guide discharging of the first printed medium, and a second paper discharging passage connected with the second buffer passage to guide discharging of the second printed medium.

The image forming unit may include a duplex passage for double-sided printing, the first paper discharging passage may be a passage through which the printed medium, on which the image forming process is completed, is discharged, and the second paper discharging passage may be a passage in which part of the printed medium, which the image forming process is completed on one surface thereof, is temporarily discharged, such that the printed medium, which the image forming process is completed on one surface thereof, is able to enter the duplex passage.

In accordance with an aspect of an exemplary embodiment, an image forming apparatus includes an image forming unit configured to form an image on a print medium, and a printed medium post-processing unit configured to receive and post-process printed media on which an image forming process is completed from the image forming unit, wherein the printed medium post-processing unit selectively comprises one of a buffer module in which the printed media, on which the image forming process is completed in the image forming unit, temporarily stay, and a transfer module which transfers the printed media, on which the image forming process is completed in the image forming unit, to the printed medium post-processing unit.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Reference is made in detail to exemplary embodiments, examples of which are illustrated in the accompanying drawings.

Figure 1:
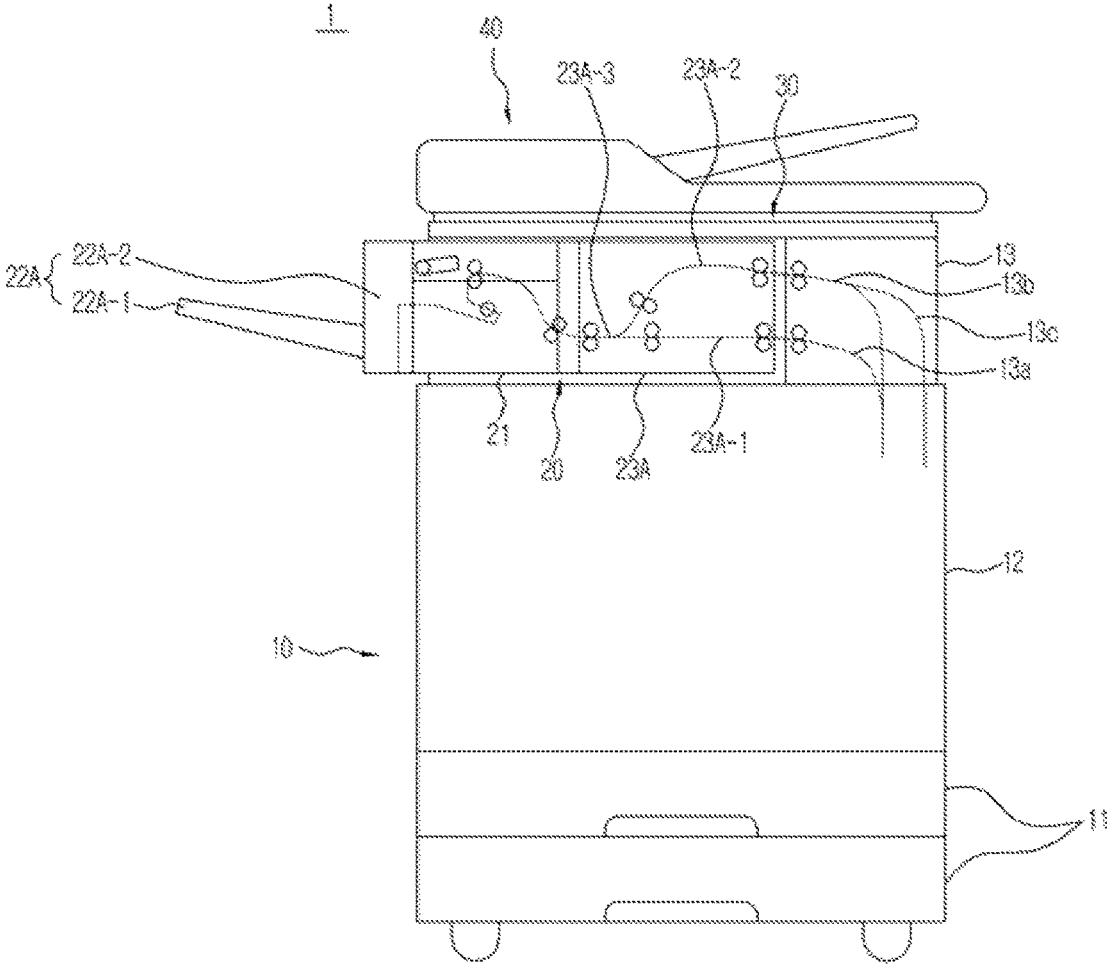
FIG. 1 is a schematic view of an image forming apparatus according to an embodiment, wherein a printed medium post-processing unit to which a first stacker module and a buffer module are applied is illustrated.

As illustrated in FIG. 1, an image forming apparatus 1 according to an embodiment includes an image forming unit 10 configured to form an image on a print medium, an image scanning unit 30 disposed at an upper side of the image forming unit 10 to scan a document, an automatic document feeding unit 40 disposed at an upper side of the image scanning unit 30 to automatically feed the document to be scanned by the image scanning unit 30, and a printed medium post-processing unit 20 configured to receive and post-process printed media on which an image forming process is completed from the image forming unit 10.

The image forming unit 10 includes a paper feeding part 11 disposed at a lower portion thereof to feed the print medium on which an image will be formed, an image forming part 12 disposed at an upper side of the paper feeding part 11 to form the image on the print medium fed from the paper feeding part 11, and a paper discharging part 13 disposed at an upper portion of one side of the image forming part 12 to discharge the printed medium on which the image forming process is completed.

The paper discharging part 13 includes a first paper discharging passage 13*a*, a second paper discharging passage 13*b* and a duplex passage 13*c* that are provided to discharge the printed medium on which the image forming process is completed. The first paper discharging passage 13*a* is a passage for discharging the printed medium on which the image forming process is completed, and the second paper discharging passage 13*b* is a passage for temporarily discharging part of the printed medium which the image forming process is completed on one surface thereof, such that the printed medium may enter the duplex passage 13*c* upon a double-sided printing process.

The printed medium post-processing unit 20 may be disposed at the upper side of the image forming part 12 to be parallel with the paper feeding part 11. According to an embodiment, the printed medium post-processing unit 20 receives and aligns the printed media discharged from the image forming unit 10 and performs a stapling, for example, in which one sides of the printed media are stapled.

The printed medium post-processing unit 20 includes a post-processing module 21 in which a post-processing process of the printed media, e.g., the aligning and stapling process of the printed media is performed, and a stacker module in which the printed media post-processed in the post-processing module 21 are loaded.

Figure 5:
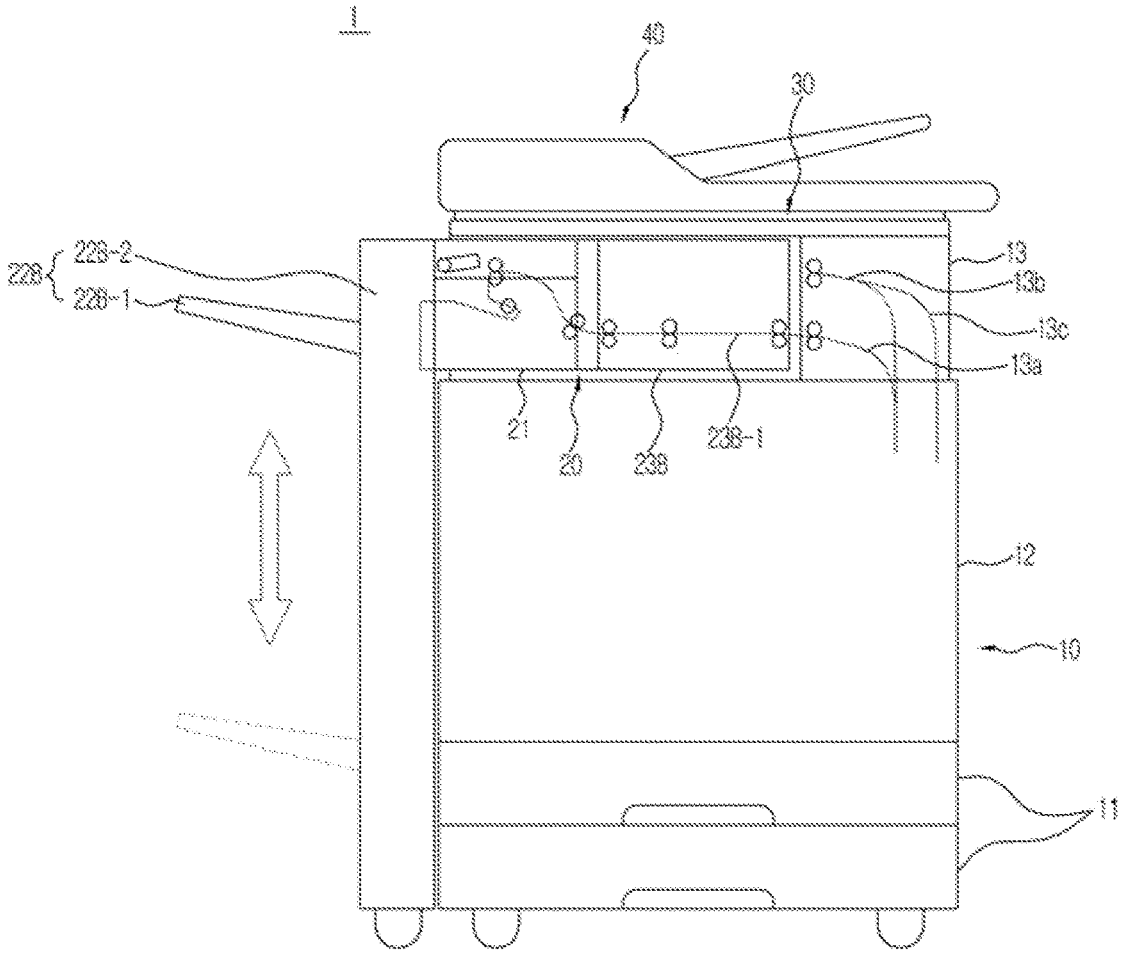
FIG. 5 is a schematic view of an image forming apparatus according to an embodiment, wherein a printed medium post-processing unit to which a second stacker module and a transfer module are applied is illustrated.

According to an embodiment, as illustrated in FIGS. 1 and 5, one of a first stacker module 22A in which a first amount of the printed media is loaded, and a second stacker module 22B in which a second amount of the printed media, which may different in amount than the first amount, for example, larger than the first amount, is loaded, may be selectively employed, and included in the printed medium post-processing unit 20.

The first stacker module 22A includes a first tray 22A-1 in which the printed media, which have been treated through the post-processing process, are loaded, and a first support part 22A-2 that fixes and supports the first tray 22A-1. As illustrated in FIG. 5, the second stacker module 22B includes a second tray 22B-1 in which the printed media, which have been treated through the post-processing process are loaded, and a second support part 22B-2 which supports the second tray 22B-1 to be movable, for example, in an up and down direction.

The second stacker module 22B extends, for example, in a vertical direction, to guide, for example, an up and down movement of the second tray 22B-1. An upper portion of the second stacker module 22B may be disposed at one side of the post-processing module, and a lower portion thereof may be disposed at one side of the image forming unit 10.

Therefore, the printed medium post-processing unit 20 includes one of the first stacker module 22A and the second stacker module 22B, and thus it may be possible to flexibly respond to a loading amount of the printed media necessary for the image forming apparatus 1. That is, in a case in which only a small loading amount is sufficient, the image forming apparatus 1 includes the printed medium post-processing unit 20 to which the first stacker module 22A is applied, and in a case in which a large loading amount is required, the image forming apparatus 1 includes the printed medium post-processing unit 20 to which the second stacker module 22B is applied. Therefore, the loading amount of the printed media necessary for the printed medium post-processing unit 20 may be selectively changed.

The printed medium post-processing unit 20 selectively includes one of a buffer module 23A in which a plurality of printed media transferred from the image forming unit 10 temporarily stay, and a transfer module 23B to directly transfer the printed media transferred from the image forming unit 10 to the post-processing module 21.

The buffer module 23A may be applied to the image forming apparatus 1 which performs a printing process at a high speed, such that the image forming process in the image forming unit 10 may be continuously performed even while the post-processing module 21 performs the post-processing process of the printed media. The buffer module 23A allows a plurality of printed media discharged from the image forming unit 10 to stay while the post-processing process of the printed media is performed in the post-processing module 21, and to transfer the plurality of printed media to the post-processing module 21 after the post-processing process of the printed media in the post-processing module 21 is completed. That is, the buffer module 23A assures a period of time for post-processing the plurality of printed media in the post-processing module 21 is available.

According to an embodiment, the buffer module 23A includes a first buffer passage 23A-1 that may be connected with the first paper discharging passage 13*a* to receive a first printed medium P1 discharged through the first paper discharging passage 13*a* and thus to allow the first printed medium P1 to temporarily stay in the buffer module 23A, a second buffer passage 23A-2 that is connected with the second paper discharging passage 13*b* to receive a second printed medium P2 discharged through the second paper discharging passage 13*b* and to allow the second printed medium P2 to temporarily stay in the buffer module 23A, and a transfer passage 23A-3 that is connected with the first buffer passage 23A-1 and the second buffer passage 23A-2 to collect and transfer the first printed medium P1 transferred through the first buffer passage 23A-1 and the second printed medium P2 to the post-processing module 21.

Figure 2:
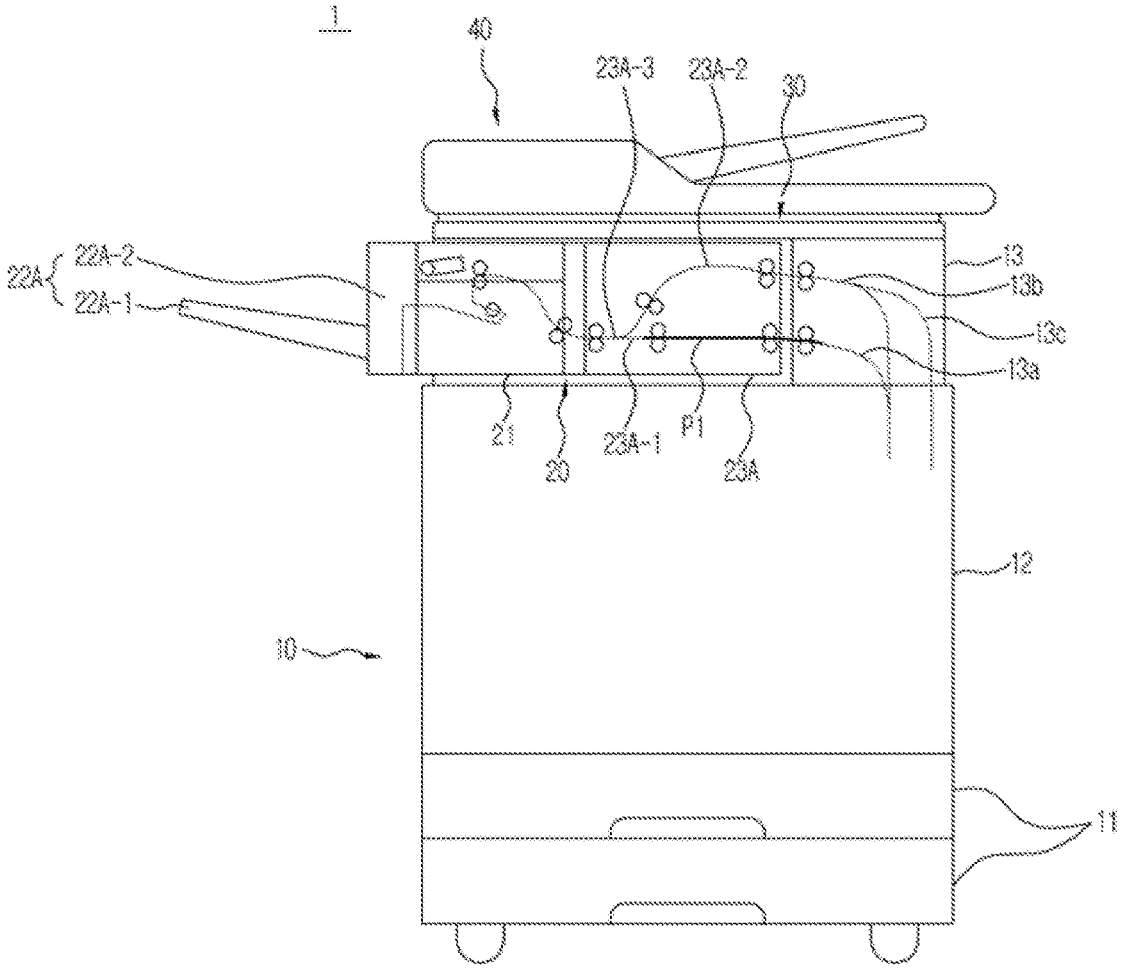
FIGS. 2 to 4 are schematic views illustrating an operation of the image forming apparatus according to an embodiment.

Therefore, while the post-processing process is performed in the post-processing module 21, the image forming unit 10 discharges the first printed medium P1 through the first paper discharging passage 13*a*. As illustrated in FIG. 2, the buffer module 23A receives the first printed medium P1 through the first buffer passage 23A-1 and allows the first printed medium P1 to stay in the first buffer passage 23A-1.

Figure 3:
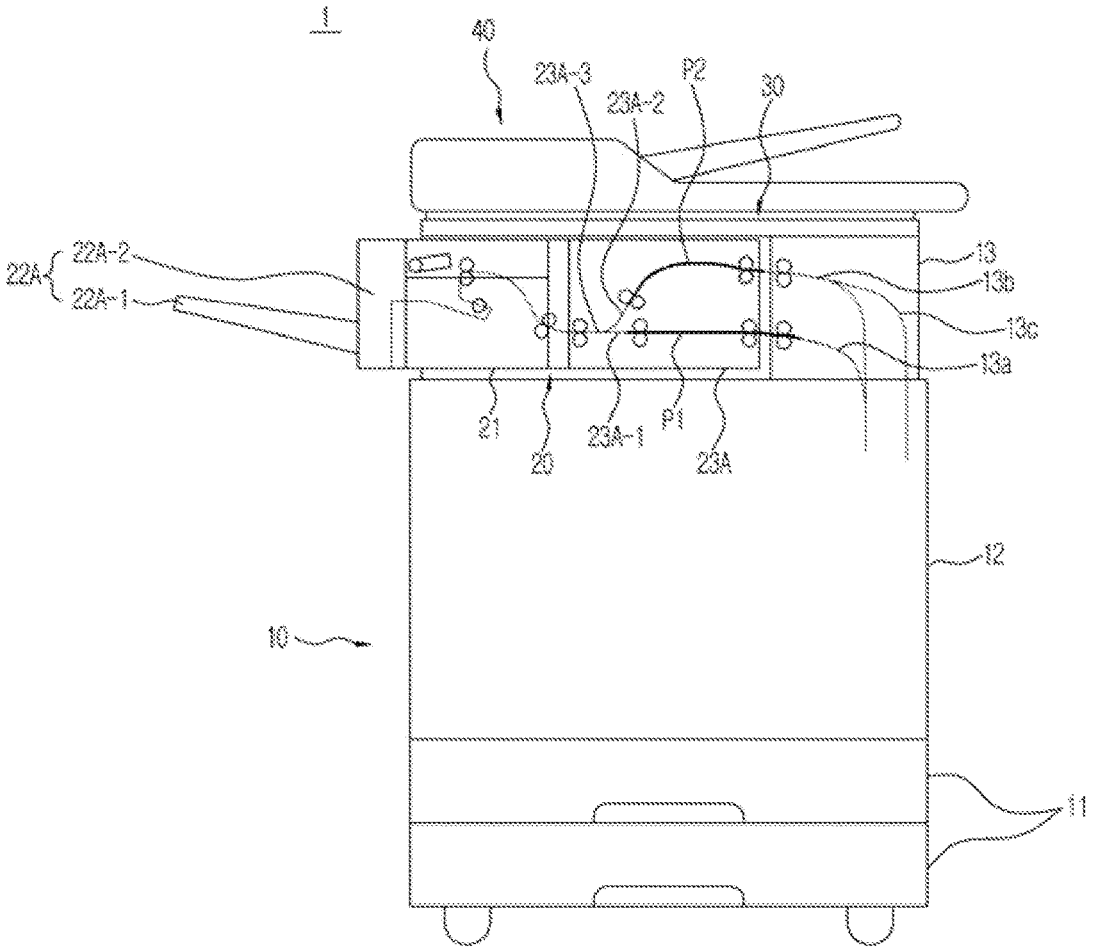

The image forming unit 10 discharges the second printed medium P2 through the second paper discharging passage 13*b*. As illustrated in FIG. 3, the buffer module 23A receives the second printed medium P2 through the second buffer passage 23A-2 and allows the second printed medium P2 to stay in the first buffer passage 23A-1. Therefore, a period of time for the post-processing process corresponding to a period of time when the images are formed on the first printed medium P1 and the second printed medium P2 may be assured.

Figure 4:
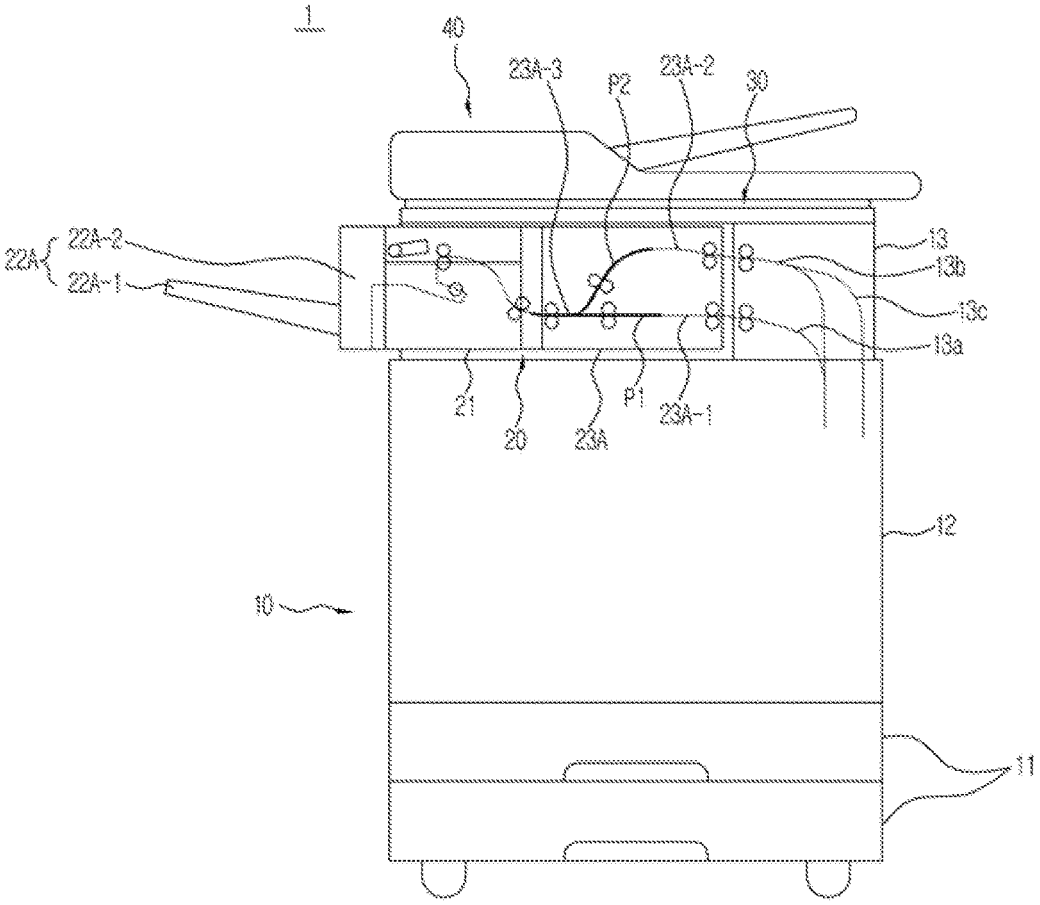

When the post-processing process is completed in the post-processing module 21, as illustrated in FIG. 4, the buffer module 23A collects the first printed medium P1 and the second printed medium P2 through the transfer passage 23A-3 and transfers both the first printed medium P1 and the second printed medium P2 to the post-processing module 21. Therefore, the image forming process in the image forming unit 10 may be continuously performed by the buffer module 23A.

The transfer module 23B illustrated in FIG. 5 may be applied to a image forming apparatus 1 that performs the printing process at a low speed. In a case of the image forming apparatus 1 that performs the printing process at the low speed, the post-processing process of the printed media in the post-processing module 21 may be completed within a period of time when the image is formed on a print medium and then the printed medium is discharged. Therefore, the buffer module 23A may not be required, and thus the printed medium transferred from the image forming unit 10 may be directly transferred to the post-processing module 21. According to an embodiment, the transfer module 23B includes a transfer passage 23B-1 configured to directly transfer the printed medium discharged from the first paper discharging passage 13*a* to the post-processing module 21.

Since the printed medium post-processing unit 20 may selectively include one of the buffer module 23A and the transfer module 23B according to the printing speed of the image forming apparatus, the printed medium post-processing unit 20 may perform the post-processing process according to the printing speed of the image forming apparatus 1.

Since the printed medium post-processing unit may selectively include one of the first stacker module and the second stacker module, it may be possible to flexibly respond to a loading amount of the printed media necessary in the printed medium post-processing unit.

Further, since the printed medium post-processing unit may selectively include one of the buffer module and the transfer module, the printed medium post-processing unit may perform the post-processing process in response to the printing speed of the image forming apparatus.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

an image forming unit configured to form an image on a print medium; and a printed medium post-processing unit configured to receive and post-process printed media on which an image forming process is completed from the image forming unit, wherein the printed medium post-processing unit selectively comprises one of a first stacker module in which a first amount of post-processed printed media is able to be loaded, and a second stacker module in which a second amount of post-processed printed media is able to be loaded, wherein the first stacker module has a first tray in which a first amount of the post-processed printed media are loadable, and a first support part configured to support the first tray and detachably mounted on one side of a post-processing module, wherein the second stacker module has a second tray in which a second amount of the post-processed printed media are loadable, and a second support part configured to support the second tray and detachably mounted on the one side of the post-processing module, wherein the printed medium post-processing unit selectively further comprises one of a transfer module that is separable from the image forming apparatus and a buffer module that is separable from the image forming apparatus, wherein when the transfer module is separated from the image forming apparatus, the buffer module is installed in the image forming apparatus and configured to temporarily store the plurality of printed media, on which the image forming process is completed in the image forming unit, prior to transfer to the post-processing module, and wherein when the buffer module is separated from the image forming apparatus, the transfer module is installed in the image forming apparatus and configured to transfer the printed media, on which the image forming process is completed in the image forming unit, to the post-processing module, wherein the image forming apparatus is configured to selectively receive either the buffer module or transfer module in the same location of the image forming apparatus.

2. The image forming apparatus according to claim 1, wherein the printed medium post-processing unit is disposed at an upper side of the image forming unit, and the second support part extends up and down so that an upper portion of the second support part is disposed at one side of the post-processing module and a lower portion of the second support part is disposed at one side of the image forming unit.

3. The image forming apparatus according to claim 1, wherein the buffer module comprises a first buffer passage in which a first printed medium, on which the image forming process is completed, is temporarily stored, a second buffer passage in which a second printed medium, on which the image forming process is completed, is temporarily stored, and a transfer passage connected with the first and second buffer passages to transfer the printed medium transferred from the first and second buffer passages to the post-processing module.

4. The image forming apparatus according to claim 3, wherein the image forming unit comprises a first paper discharging passage connected with the first buffer passage to guide discharging of the first printed medium, and a second paper discharging passage connected with the second buffer passage to guide discharging of the second printed medium.

5. The image forming apparatus according to claim 4, wherein the image forming unit comprises a duplex passage for double-sided printing, the first paper discharging passage is a passage through which the printed medium, on which the image forming process is completed, is discharged, and the second paper discharging passage is a passage in which part of the printed medium, which the image forming process is completed on one surface thereof, is temporarily discharged, such that the printed medium, which the image forming process is completed on one surface thereof, is able to enter the duplex passage.

6. An image forming apparatus comprising:

an image forming unit configured to form an image on a print medium; and a printed medium post-processing unit configured to receive and post-process printed media on which an image forming process is completed from the image forming unit, wherein the printed medium post-processing unit selectively comprises one of a transfer module that is separable from the image forming apparatus and a buffer module that is separable from the image forming apparatus, wherein when the transfer module is separated from the image forming apparatus, the buffer module is installed in the image forming apparatus and configured to temporarily store the printed media, on which the image forming process is completed in the image forming unit prior to transfer to a post-processing module, and wherein when the buffer module is separated from the image forming apparatus, the transfer module is installed in the image forming apparatus and configured to transfer the printed media, on which the image forming process is completed in the image forming unit, to the post-processing module, wherein the image forming apparatus is configured to selectively receive either the buffer module or transfer module in the same location of the image forming apparatus.

7. The image forming apparatus according to claim 6, wherein the buffer module comprises a first buffer passage in which a first printed medium, on which the image forming process is completed, is temporarily stored, a second buffer passage in which a second printed medium, on which the image forming process is completed, is temporarily stored, and a transfer passage connected with the first and second buffer passages to transfer the printed medium transferred from the first and second buffer passages to the post-processing module.

8. The image forming apparatus according to claim 7, wherein the image forming unit comprises a first paper discharging passage connected with the first buffer passage to guide discharging of the first printed medium, and a second paper discharging passage connected with the second buffer passage to guide discharging of the second printed medium.

9. The image forming apparatus according to claim 8, wherein the image forming unit comprises a duplex passage for double-sided printing, the first paper discharging passage is a passage through which the printed medium, on which the image forming process is completed, is discharged, and the second paper discharging passage is a passage in which part of the printed medium, which the image forming process is completed on one surface thereof, is temporarily discharged, such that the printed medium, which image forming process is completed on one surface thereof is able to enter the duplex passage.

* * * * *